United States Patent [19]

de La Chapelle

[11] 4,305,632

[45] Dec. 15, 1981

[54] METHOD OF MAKING TUNGSTEN HALOGEN CAPSULE FOR HEADLIGHT

[75] Inventor: Richard de La Chapelle, Hancock, N.H.

[73] Assignee: GTE Products Corporation, Stamford, Conn.

[21] Appl. No.: 107,306

[22] Filed: Dec. 26, 1979

[51] Int. Cl.[3] ..... H01J 9/385

[52] U.S. Cl. ..... 316/18

[58] Field of Search ..... 316/19; 29/25.15, 25.16

[56] References Cited

U.S. PATENT DOCUMENTS 1,883,174 10/1932 Von Wedel ..... 316/19

2,123,015 7/1938 Marden et al. ..... 316/19

*Primary Examiner*—Joseph H. McGlynn

*Attorney, Agent, or Firm*—James Theodosopoulos

[57] ABSTRACT

In the manufacture of a tungsten halogen capsule containing two coiled filaments, the required spacing between filaments is maintained during press sealing by means of a positioning device inserted into the capsule tube at the end opposite the press seal.

5 Claims, 6 Drawing Figures

METHOD OF MAKING TUNGSTEN HALOGEN CAPSULE FOR HEADLIGHT

BACKGROUND OF THE INVENTION

This invention is concerned with tungsten halogen lamps, commonly called capsules, for use in vehicle headlights. It is particularly concerned with such capsules containing two coiled tungsten filaments, a high beam filament and a low beam filament. An example of such a capsule is shown in U.S. Pat. No. 4,140,939. The spacing between filaments must be held quite closely in the finished capsule and this has presented problems in manufacture. One method of making such capsules is shown in U.S. Pat. No. 4,166,232. There, the filaments were mounted on U shaped legs which were supported in a block. The filaments were then inserted into one end of a glass tube, the other end of which had been necked down, and the glass was heated and pressed onto the legs to form a press seal, the blocks remaining outside the glass. The capsule was then exhausted, filled and sealed through the necked down end of the glass tube. A problem with said method is that the heating of the wires and pressing of the softened glass thereon often shifted the filament spacing out of tolerance.

BRIEF DESCRIPTION OF THE DRAWINGS

This invention will be more fully described hereinafter in conjunction with the accompanying drawings, in which.

THE INVENTION

In this invention, the spacing between filaments is accurately maintained during capsule manufacture by means of a positioning device which directly holds the filaments in the required spacing throughout the press sealing operation. The positioning device is inserted through the other end of the glass tube which, for this purpose, has not been necked down. After the press seal has been made, the positioning device is withdrawn, said end of the glass tube is then tubulated or necked down, and the exhausting, filling and final sealing are made therethrough.

Figure 1:
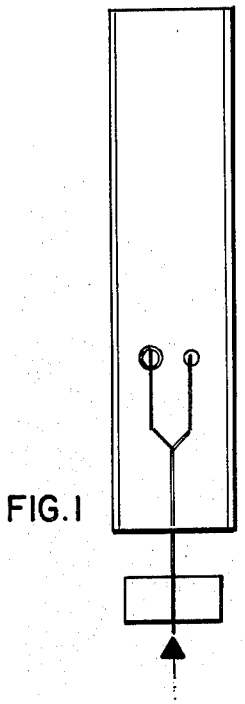
FIG. 1 shows the step of filament insertion into glass tube.
Figure 2:
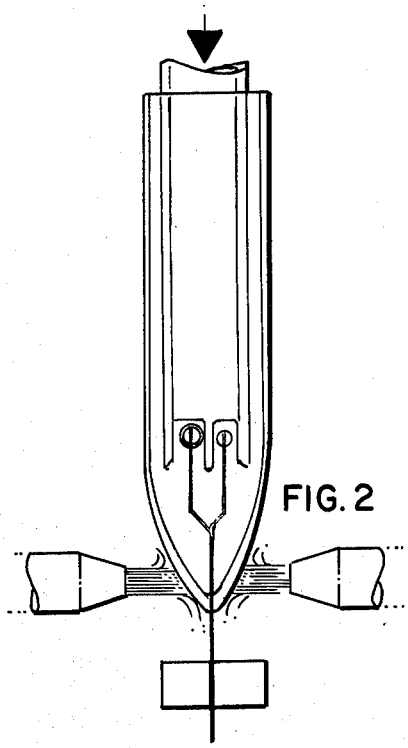
FIG. 2 shows the steps of insertion of positioning device and heating end of glass tube.
Figure 3:
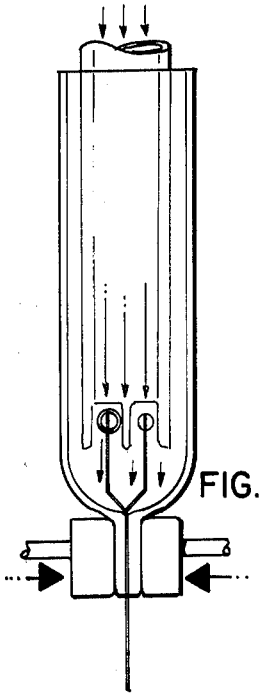
FIG. 3 shows the steps of forming a press seal and introducing inert gas.
Figure 4:
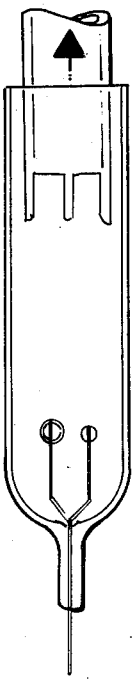
FIG. 4 shows the step of withdrawing positioning device.

In one example, for a tungsten-halogen capsule for use with a 2B automobile headlight, the beginning tube was made of hard glass, about $1\frac{1}{4}$ mm thick, and was about 9/16 inch diameter by $2\frac{3}{8}$ inch long. The body of one coiled filament was about 161 mils long by 59 mils diameter, and of the other, 217 mils long by 34 mils diameter. The filaments were mounted on 13 mil molybdenum wire legs, about 18 mm long, which were butt welded to U shaped 40 mil nickel plated steel wire supports about 40 mm long. Referring to FIG. 1, the filaments were inserted into one end of the glass tube and held there by means of external retainers holding the wire supports. Referring to FIG. 2, a positioning device was inserted into the other end of the glass tube to maintain the desired spacing for the filaments. The positioning device was a metal rod $\frac{3}{8}$ inch diameter by $8\frac{1}{2}$ inch long. One end of the rod contained two slots 100 mils deep. One slot was 65 mils wide and to other was 37 mils wide. There was a 37 mil thick metal separator between the slots and the center to center spacing of the slots was 88 mils, which was the required center to center spacing of the filaments. The positioning rod was inserted substantially coaxially into the glass tube so that each filament nested into a slot. This position was maintained until the first end of the glass tube had been heated to its softening point (FIG. 2) and pressed together onto the filament legs to form a press seal (FIG. 3). During this operation (FIG. 3), an inert gas was introduced, through a longitudinal hole in the positioning rod, into the glass tube around the filaments, the purpose being to prevent oxidization of the filaments and legs during press sealing. When the press seal had cooled sufficiently, the positioning device was withdrawn (FIG. 4). The press seal was about 10 mm long by 14 mm wide and embedded part of the nickel plated steel support wires. The glass length including the press seal was $2\frac{1}{4}$ inch long.

Figure 5:
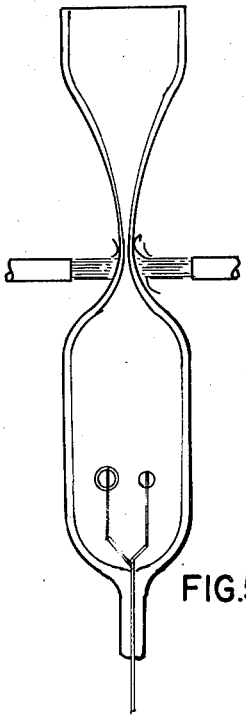
FIG. 5 shows the step of necking down glass tube.
Figure 6:
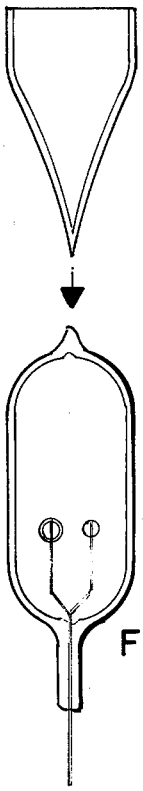
FIG. 6 shows the step of tipping off glass tube.

Referring to FIG. 5, the open end of the glass tube was then necked down by heating the glass at about an inch from the end and drawing it to form an exhaust tubulation about 3/32 inch diameter by $\frac{3}{4}$ inch long. The exhausting and filling (with halogen and inert gas) was made through the tubulation, which was then tipped off to seal the capsule (FIG. 6). The overall glass length of the finished capsule, including the press seal, was $1\frac{3}{8}$ inch.

In this example, the filaments were transverse to the capsule axis and the positioning device had slots to contain and position the filaments. In the event that one or both filaments were axially or longitudinally disposed in the capsule, the positioning device could have longitudinal grooves or holes to contain the filaments during press sealing.

I claim:

1. The method of making a tungsten halogen capsule containing two coiled filaments within a glass envelope comprising the steps of: inserting said two filaments, mounted on filament legs, into one end of a glass tube; inserting a positioning device into the other end of the glass tube and disposing said device about the filaments in such a manner as to maintain a predetermined spacing between the filaments during the next step of press sealing; press sealing said one of the glass tube onto the filament legs; removing the positioning device; necking down said other end of the glass tube to form an exhaust tubulation; and exhausting, filling and sealing said capsule through said tubulation.

2. The method of claim 1 wherein an inert gas is introduced into the glass tube through the positioning device during the press sealing operation.

3. The method of claim 1 wherein the positioning device contains two slots into which the filaments nest.

4. A tungsten halogen capsule made in accordance with claim 1.

5. The method of making a tungsten halogen capsule containing two coiled filaments within a glass envelope comprising the steps of: disposing two filaments into a glass tube; supporting said filaments by support means, including filament legs, located at one end of the glass tube; inserting a positioning device into the other end of the glass tube and disposing said device about the filaments in such a manner as to maintain a predetermined spacing between the filaments during the next step of press sealing; press sealing said one end of the glass tube to embed a portion of the filament legs or other parts of the support means in the press seal; removing the positioning device; necking down said other end of the glass tube to form an exhaust tubulation; and exhausting, filling and sealing said capsule through said tubulation.

* * * * *